US007178578B2

(12) United States Patent
Kolbeck et al.

(10) Patent No.: US 7,178,578 B2
(45) Date of Patent: Feb. 20, 2007

(54) CONTINUOUS CASTING ROLL

(75) Inventors: Dietmar Kolbeck, Steinfeld (DE); Hans-Günter Wobker, Bramsche (DE); Gerhard Hugenschütt, Belm (DE)

(73) Assignee: KM Europa Metal AG, Osnabruck (DE)

( * ) Notice: Subject to any disclaimer, the term of this patent is extended or adjusted under 35 U.S.C. 154(b) by 0 days.

(21) Appl. No.: 10/918,013

(22) Filed: Aug. 13, 2004

(65) Prior Publication Data

US 2005/0034839 A1 Feb. 17, 2005

(30) Foreign Application Priority Data

Aug. 13, 2003 (DE) ..... 103 37 174

(51) Int. Cl.
*B22D 11/12* (2006.01)

(52) U.S. Cl. ..... 164/442; 164/448

(58) Field of Classification Search ..... 164/442, 164/448

See application file for complete search history.

(56) References Cited

U.S. PATENT DOCUMENTS 4,722,212 A * 2/1988 Ginzburg et al. ..... 72/241.4
4,813,258 A * 3/1989 Ginzburg ..... 72/243.6
5,093,974 A * 3/1992 Ginzburg ..... 492/2
5,347,837 A * 9/1994 Ginzburg ..... 72/243.6

* cited by examiner

*Primary Examiner*—Len Tran
(74) *Attorney, Agent, or Firm*—Kenyon & Kenyon LLP

(57) ABSTRACT

A continuous casting roll for the continuous casting of metal strip. The continuous casting roll has an essentially cylindrical core and a jacket, for example, made of a copper alloy, that is shrunk onto it. A relaxation zone is provided between the core and jacket. The relaxation zone, for example, having a radial extension of 1 mm, may be formed by a regional increase in the inside diameter of the jacket, and may be situated in the middle longitudinal range of the jacket.

7 Claims, 1 Drawing Sheet

CONTINUOUS CASTING ROLL

RELATED APPLICATIONS

The present application claims priority to German Patent Application Serial No. 103 37 174.5, filed Aug. 13, 2003, the entire disclosure of which is incorporated herein by reference.

FIELD OF THE INVENTION

The present invention relates to a continuous casting roll for a cast-rolling plant for the continuous casting of metal strip.

BACKGROUND INFORMATION

In cast-rolling, liquid steel or other, nonferrous metals are cast between two continuous casting, counter-rotating rolls that are horizontally or vertically situated one over the other and sealed on their sides. In this operation, the strip solidifies between the two continuous casting rolls and is continuously advanced in the process.

Continuous casting rolls of the current design type have a cylindrical core, usually made of steel, and a jacket connected to it. In the cast-rolling of steel, substances having high heat conductivity, such as copper or copper alloys are usually employed as the material for the jacket. In the casting of nonferrous metals, steel jackets are normally used.

Two current methods of making the connection between the core and the jacket of the continuous casting roll include hot isostatic pressing and a shrinking technique for the pressing connection between jacket and core. In hot isostatic pressing the jacket and core are joined to each other under high pressure and temperature. In the shrinking technique for the pressing connection between jacket and core, which is the most widespread method, before joining, the jacket is heated and then pushed over the core. Upon cooling, the pressing connection forms by the shrinking of the jacket.

Because of the shrinking procedure, the jacket experiences tensile stresses. When used in operation during a casting procedure, a deformation or swelling of the roll may occur as a function of the rigidity of the construction and the acting forces. As a result, in the edge zones of the continuous casting roll, load stresses may arise which overlap with the acting stresses from the shrinking procedure. These stresses, under load, may lead to the formation of cracks in response to the acting fatigue stress.

Starting from the related art, an object of the present invention is to create an improved continuous casting roll for operational use, in which stress during operation is reduced.

SUMMARY OF THE INVENTION

In an exemplary embodiment of the present invention, the continuous casting has an essentially cylindrical core and a jacket shrunk onto it that is made of a material of high heat conductivity, such as copper or a copper alloy, and a relaxation zone between the core and the jacket of the continuous casting roll, by which a local reduction in the shrinking stress takes place. This results in a reduction of the effective stresses in the regions that are most stressed under load. In this way, the creation of material fatigue and crack formation as a result of stress are avoided, which leads to an increase in the service life of a continuous casting roll. In addition, the running properties of the continuous casting roll are improved thereby.

The relaxation zone is formed by a profiling of the outer diameter of the core and/or the inner diameter of the jacket. In one exemplary embodiment, the relaxation zone is formed by a regional reduction in the outer diameter of the core. In another exemplary embodiment, the relaxation zone is created by a regional increase in the inner diameter of the jacket.

One advantageous feature of an exemplary embodiment of the present invention is that the relaxation zone is in the middle of the longitudinal range of the core and/or the jacket. This feature is advantageous because the maximum stress, resulting from the superimposition of the shrinking stresses and the load stresses, appears in the middle range of the continuous casting roll. The shrinking stresses in this middle range is purposefully reduced by the relaxation zone, in order to lower the effective stress under load.

In an exemplary embodiment of the present invention, the relaxation zone may also lie in the outer regions of a roll, if there is a corresponding loading of the rolls, for instance, in response to unfavorable cooling conditions.

Depending on rigidity and construction of the continuous casting roll, in an exemplary embodiment of the invention the relaxation zone is advantageously provided on a length equivalent to 0.2 to 0.8 times the total length of the core and/or the jacket.

In an exemplary embodiment of the present invention, the relaxation zone expediently has a radial extent of 0.6 to 2.0 mm. A radial extent of 1 mm is regarded as particularly effective.

In the continuous casting roll according to an exemplary embodiment of the present invention, core and jacket are reliably connected at sufficiently high pressure by a force-locking connection, as a result of the shrink seating. Nevertheless, the shrinking stresses may be purposefully reduced in the highly stressed ranges, and thus, a lowering of the effective stress may be achieved present invention is explained in more detail below, using an exemplary embodiment represented in the drawings.

DETAILED DESCRIPTION

Figure 1:
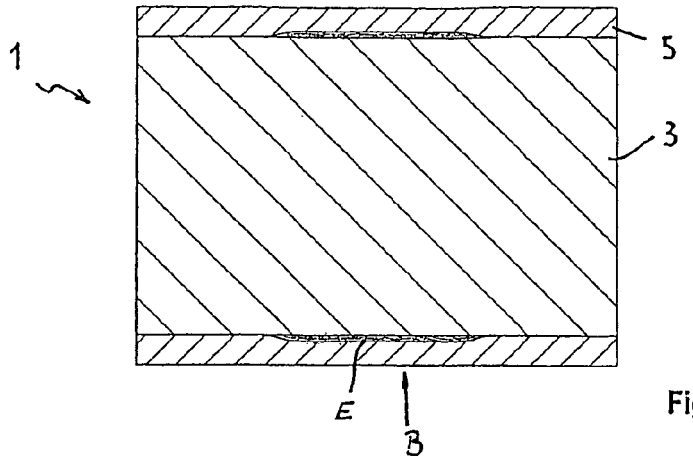
FIG. 1 is a technically simplified vertical longitudinal section of an exemplary embodiment of a continuous casting roll.
Figure 2:
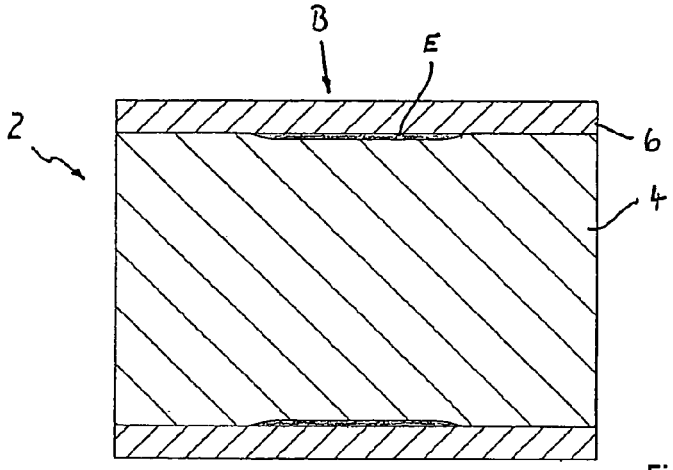
FIG. 2 is a vertical longitudinal section of another exemplary embodiment of a continuous casting roll according to the present invention.

FIGS. 1 and 2 each show a continuous casting roll 1 or 2 for a continuous cast-rolling plant for continuous casting of metal strip. Each of continuous casting rolls 1, 2 has a cylindrical core 3, 4 made of steel, and a jacket 5, 6, made of a copper alloy, shrunk onto it.

For clarity, additional components, such as the shaft, bearings and other add-on parts, or cooling channels, are not shown in the drawings.

As indicated above, jacket 5 or 6 and core 3 or 4 are connected to one another respectively by a shrinking technique. Because of the shrinking procedure, the jacket 5, 6 experiences tensile stress. These stresses superimpose themselves on the operating load stresses to form the so-called effective stress. This maximum stress is created in the middle region, labeled B, of a continuous casting roll 1 or 2. These regions B tend to be favored when it comes to crack formation under load, in response to fatigue stress.

In order to reduce the shrinking stresses that come about from the shrink seating between core 3, 4 and jacket 5, 6, a relaxation zone, labeled E, is provided between core 3, 4 and jacket 5, 6. This relaxation zone E is purposefully applied to region B, where one may count on the highest stress during the operational use of continuous-casting roll 1, 2.

Figure 3:
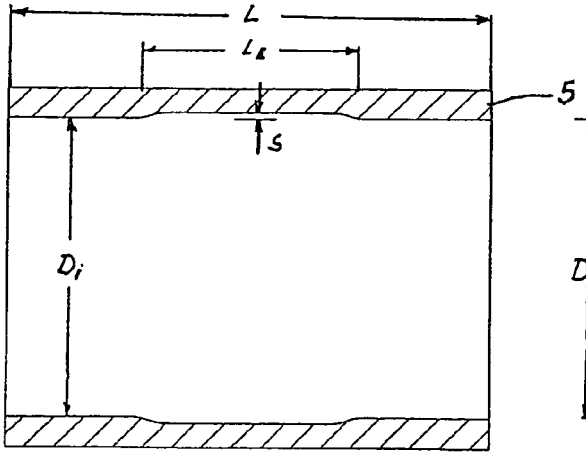
FIG. 3 is a vertical longitudinal section of the jacket of the continuous casting roll of FIG. 1.

In the exemplary embodiments of continuous casting rolls 1 and 2 illustrated, for an aluminum continuous cast-rolling plant, a relaxation zone, labeled E, is provided in the middle longitudinal range of jacket 5, 6. In continuous casting roll 1, as may also be recognized particularly in FIG. 3, relaxation zone E is formed by a regional increase in inside diameter D of jacket 5. At this point, relaxation zone E has a radial extent s of 0.6 to 2.0 mm, preferably of 1 mm.

Figure 4:
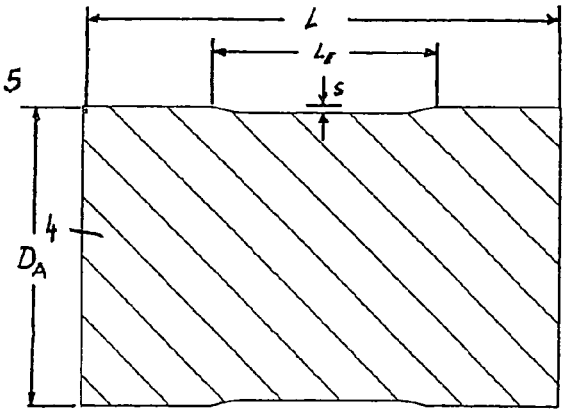
FIG. 4 is a vertical longitudinal section of the jacket of the continuous casting roll of FIG. 2.

In continuous casting roll 2, relaxation zone E is formed by a regional reduction in the outside diameter $D_A$ of core 4 (see also FIG. 4). In this case, outside diameter $D_A$ is radially reduced on a partial basis in the middle longitudinal range of core 4. Here too, relaxation zone E has an extent, labeled s, of between 0.6 and 2.0 mm, preferably 1 mm.

In practice, relaxation zone E is executed in different lengths, depending on the specific embodiment of a continuous casting roll 1, 2 and the type of application. In this connection, the length $L_E$ of relaxation zone E may be between 0.2 and 0.8 times the overall length L of core 3, 4, and/or of jacket 5, 6.

After the shrinking-on process, jackets 5 and 6 each lie on cores 3 and 4 respectively, in a planar manner. Relaxation zone E is shown in oversized fashion in the exemplary embodiments illustrated for clarity. In practice, after shrinking on, there is no gap between jacket 5, 6 and core 3, 4, respectively. Because of relaxation zone E, that is purposefully provided in the regions of the greatest load, a regional reduction in the shrinking stress is achieved. In the highly loaded regions, this leads to a lowering in the maximum stress.

List of Reference Numerals

1—continuous casting roll

2—continuous casting roll

3—core

4—core

5—jacket

6—jacket

B—region

E—relaxation zone $D_I$—inside diameter of 5, 6

$D_A$—outside diameter of 3, 4 s—radial extension of E

L—length of 3, 4 and 5, 6, respectively

What is claimed is:

1. A continuous casting roll for the continuous casting of metal strip, comprising:

an essentially cylindrical core; and a jacket shrunk onto the core made of a material of high heat conductivity relative to the core such that there is no gap between the jacket and the core, wherein a relaxation zone is provided between the core and the jacket and is formed by a regional increase in a radial thickness of the jacket.

2. A continuous casting roll for the continuous casting of metal strip, comprising:

an essentially cylindrical core; and a jacket shrunk onto the core made of a material of high heat conductivity relative to the core such that there is no gap between the jacket and the core, wherein a relaxation zone is provided between the core and the jacket, and wherein the relaxation zone lies in a middle longitudinal range of at least one of the core and the jacket; and is formed by one of (i) a regional reduction in an outside diameter of the core, the outer diameter of the core being larger on both sides of the regional reduction, and (ii) a regional increase in a radial thickness of the jacket.

3. The continuous casting roll of claim 1, wherein the relaxation zone lies in outer ranges of at least one of the core and the jacket.

4. A continuous casting roll for the continuous casting of metal strip, comprising:

an essentially cylindrical core; and a jacket shrunk onto the core made of a material of high heat conductivity relative to the core, wherein a relaxation zone is provided between the core and the jacket, and wherein a length of the relaxation zone is 0.2 to 0.8 times an overall length of at least one of the core and the jacket.

5. A continuous casting roll for the continuous casting of metal strip, comprising:

an essentially cylindrical core; and a jacket shrunk onto the core made of a material of high heat conductivity relative to the core, wherein a relaxation zone is provided between the core and the jacket, and wherein a radial extent of the relaxation zone is between 0.6 to 2.0 mm.

6. The continuous casting roll of claim 1, wherein core is made from one of copper and a copper alloy.

7. A continuous casting roll for the continuous casting of metal strip, comprising:

an essentially cylindrical core; and a jacket shrunk onto the core made of a material of high heat conductivity relative to the core, wherein a relaxation zone is provided between the core and the jacket, and wherein a radial extent of the relaxation zone is 1.0 mm.

* * * * *